United States Patent [19]

Andreshak et al.

[11] Patent Number: 5,066,370

[45] Date of Patent: Nov. 19, 1991

[54] APPARATUS, ELECTROCHEMICAL PROCESS, AND ELECTROLYTE FOR MICROFINISHING STAINLESS STEEL PRINT BANDS

[75] Inventors: Joseph C. Andreshak, Mahopac; Madhav Datta, Peekskill; Lubomyr T. Romankiw, Briarcliff Manor, all of N.Y.; Luis F. Vega, Simsbury, Conn.

[73] Assignee: International Business Machines Corporation, Armonk, N.Y.

[21] Appl. No.: 578,971

[22] Filed: Sep. 7, 1990

[51] Int. Cl.[5] ..... C25F 3/00; C25F 3/06; C25F 3/24; C25F 7/00

[52] U.S. Cl. ..... 204/129.1; 204/129.35; 204/129.8; 204/129.85; 204/129.9; 204/129.95; 204/228; 204/211; 204/237; 204/274; 204/277

[58] Field of Search ..... 204/129.35, 129.46, 204/129.85, 129.8, 129.95, 129.9, 129.75, 206, 209, 217, 211, 129.1, 237, 228, 274, 277

[56] References Cited

U.S. PATENT DOCUMENTS

| | | | |
|---|---|---|---|
| 2,430,028 | 11/1947 | Pfann et al. | 204/129.55 X |
| 2,752,305 | 6/1956 | Turner | 204/129.9 |
| 3,821,093 | 6/1974 | Carron et al. | 204/129.9 X |

FOREIGN PATENT DOCUMENTS

| | | | |
|---|---|---|---|
| 136001 | 10/1947 | Australia | 204/129.9 |
| 704945 | 3/1954 | United Kingdom | 204/129.9 |

*Primary Examiner*—Donald R. Valentine
*Attorney, Agent, or Firm*—Ratner & Prestia

[57] ABSTRACT

An apparatus is provided for electrochemically processing an anodic material in strip form, such as the stainless steel print bands used in high speed printers. Also provided is an electrochemical process including electroetching, electropolishing, or both to obtain microfinishing of the material. Moreover, an electrolyte is provided which is a mixture of phosphoric acid, sulfuric acid, and glycerol in which the material removal rate is controlled by the addition of small amounts of sodium chloride. The electrochemical process operates at ambient temperature over a wide range of current density.

29 Claims, 1 Drawing Sheets

APPARATUS, ELECTROCHEMICAL PROCESS, AND ELECTROLYTE FOR MICROFINISHING STAINLESS STEEL PRINT BANDS

BACKGROUND OF INVENTION

A. Field of Invention

The present invention relates, in general, to an apparatus, an electrolyte, and a process for electrochemically microfinishing metals provided in the form of a strip or a band. More particularly, the present invention relates to an apparatus and to an electrochemical process incorporating an electrolyte solution including glycerol for electropolishing and electroetching stainless steel print bands.

B. Description of Related Art

In the manufacture of print bands used in high-speed, impact printers, final surface finishing is an important step. The surface of these print bands, which are typically hardened stainless steel, must have special characteristics in order to resolve properly the tradeoff between ribbon life and print quality. Currently, mechanical buffing is used for final finishing of print bands.

Buffing is done by nylon brushes impregnated with an abrasive such as alumina, TiC, or the like at the brush tips. The tips of the brushes break off unevenly during the finishing process, rendering the process highly irreproducible. The buffing process is also relatively slow and yields an inferior surface finish. Specifically, although buffing removes the original surface roughness to a certain extent, it introduces numerous scratches which are unevenly distributed over the surface. Moreover, mechanically induced stresses are present in the surface following buffing.

Certain printer applications demand that the characters on the print band be rounded with a different degree of rounding at the leading and trailing edges. Such rounding requires a degree of carefully controlled metal removal during final finishing.

To obtain the desired microfinish of, and the desired degree of metal removal from, the stainless steel print bands, electropolishing and electroetching are herein suggested. The technological aspects of electrolytic polishing of stainless steels, including operating conditions and electrolyte composition, are well documented. See, e.g., J. F. Jumer, *Metal Finishing Guidebook Directory* at 513 (Metals and Plastics Publications, Hackensack, N.J., 1972); W. Schwartz, 68 *Plating and Surface Finishing* at 42 (June 1981); I. Rajagopalan, *Finishing Industries* at 27 (Sept. 1978); S. J. Grilichies, *Electrochimicheskoje polirowanie* (Leningrad, 1976); P. V. Shigolev, *Electrolytic and Chemical Polishing of Metals* (Freund, Tel-Aviv, 1974); W. J. McTegart, *The Electrolytic and Chemical Polishing of Metals* (Pergamon Press, London, 1956); J. P. Hoare & M. A. LaBoda, 2 *Comprehensive Treatise of Electrochemistry* (J.O'M Bockris, B. Conway, E. Yeager & R. E. White eds., Plenum Press, 1981); L. Ponto, M. Datta & D. Landolt, 30 *Surface and Coatings Technology* at 265 (1987). These references indicate that electrolytic polishing of stainless steels on an industrial scale is most easily done in concentrated phosphoric acid-sulfuric acid solutions.

Electrolytes based on perchloric acid-acetic acid have also been used on a laboratory scale. W. J. McTegart, *Electrolytic & Chemical Polishing of Metals* (Pergamon Press, London, 1956). Perchloric acid with organics such as acetic acid or acetic anhydride are seldom used today, however, because they have an explosive nature. Accordingly, solutions based on a mixture of phosphoric and sulfuric acids are more important. W. J. McTegart, *Polissage electrolytique et chimique des Metals* (Dunod, Paris, 1960).

For electropolishing of stainless steels, the known solutions sometimes have additives and the electrolytic process is conducted at elevated temperatures. Several patents and publications have mentioned the use of different additives, including glycerol. See, for example, U.S. Pat. No. 2,315,695 (Faust); P. V. Shigolev, *Electrolytic & Chemical Polishing of Metals*, (Freund, Tel-Aviv, 1974); W. J. McTegart, *Electrolytic & Chemical Polishing of Metals* (Pergamon Press, London, 1956). None of the electropolishing baths disclosed, however, take into consideration the manufacturing aspects; therefore, they are not directly applicable for microfinishing in the print band manufacturing process.

For example, the 59–64% glycerol bath mentioned in the '695 patent would involve a high cell voltage, creating electrolyte heating and a large power requirement. For electropolishing materials with spring-type characteristics, excessive heating would destroy such properties. Most of the glycerol-containing baths mentioned in the literature operate at high temperatures (40–90 degrees Centigrade). Moreover, such baths generally contain further additives, thus making them difficult to adapt to manufacturing processes in the electronics industry.

The surface finish obtained by using the known processes is generally very sensitive to changes in operating conditions—in particular, current density, temperature, and hydrodynamic conditions. Specifically, with respect to current density, prolonged application of relatively high currents (up to 60 amperes) to thin, moving print bands (about 150 microns thick) may create heating problems. Especially at the point of electrical connection, such problems may include sparking and burning of the band. High current requirements also demand high cell voltage and, consequently, high power supplies. Unfortunately, such problems are difficult to avoid if sufficient anodic dissolution cannot be obtained without using high current densities.

Depending upon the electrolyte solution and the operating conditions used, anodic dissolution of a metallic workpiece may lead to any one of the following: (1) anodic etching, revealing crystallographic steps and etch pits, preferred grain boundary attack, or finely dispersed microtexture; (2) partial or complete passivation; and (3) electropolished surfaces. Oxygen evolution may accompany the metal dissolution reaction which occurs during electropolishing. Moreover, the success of electropolishing depends upon the prevailing mass transport and current distribution conditions and on the ability to form surface films on the dissolving anode. These factors, in turn, depend upon the specific metal-electrolyte interaction, hydrodynamic conditions, applied current density and cell voltage, and the cell geometry. Development and control of an electrolytic process, therefore, requires control of the interaction between these parameters and the influence of the parameters on the resulting surface finish of the metal.

In addition to the electrochemical factors which govern the process of electrolytic finishing, optimization and successful application of the process depend on several other factors. Such factors include: metal composition, grain size, inclusions, initial surface state, and initial surface roughness. Although an electrolytic process can create highly reflecting, mirror-like, microscopically flat surfaces, such results are obtained generally only for pure metals and homogeneous alloys containing small amounts of inclusions. Successful electropolishing of two-phase alloys, on the other hand, is much more difficult to achieve.

That difficulty is caused, in part, by differences in the rates of dissolution of the different phases, creating extremely rough surfaces. For similar reasons, anodic dissolution of alloys containing significant amounts of inclusions yields pitting and other forms of localized attack. Thus, to develop a successful electrolytic process for microfinishing such materials, conditions which suppress localized and preferential dissolution must be ascertained.

The significant amount of inclusions present in the stainless steels used to manufacture print bands renders electropolishing of such materials difficult. Previously known electrolytic solutions and conditions, and the devices used to apply those solutions and conditions, have proven inadequate.

With the above discussion in mind, it is one object of the present invention to provide a completely automated device able to electropolish and electroetch materials provided in strip form, such as print heads. A related object is to provide a device which includes provisions for selective removal of material from the corners of the characters, giving enhanced control over the character profile, and for uniform levelling and microfinishing of the entire print band surface. A further object is to provide an apparatus which reduces the number of passes of the print band required to obtain acceptable surface finish, thereby increasing output. Another object is to provide an apparatus able to produce better reproducibility and better surface finish than existing devices. Finally, another object is to reduce the current required by the apparatus.

The following objects are attendant the electrolytic process of the present invention. The process should: (a) be non-explosive and should not contain toxic components; (b) be operable at ambient temperature and be insensitive to small variations in electrolyte temperature, thereby minimizing losses due to evaporation generally encountered in processes which operate at elevated temperatures; (c) involve minimal agitation of the electrolyte, thus eliminating the high cost involved in pumping concentrated acids; (d) provide microfinishing at relatively low current density; (e) provide a desired and controlled material removal rate; and (f) ensure safety.

Another object is to provide an electrolyte with a sufficiently high conductivity so that power requirements are relatively low. A related object is to assure that the electrolyte is relatively noncorrosive and remains stable, without polymerization or other degradation, over long periods of time.

SUMMARY OF THE INVENTION

To achieve these and other objects, and in view of its purposes, the present invention provides an apparatus for electropolishing an anodic material in strip form including a movable plate; elements attached to the plate for moving the material at a predetermined speed; a tank positioned at a predetermined distance from the elements and containing a cathode assembly and an electrolyte; a housing having a cathode and defining a slot through which electrolyte flows before impinging on the material; a first electrical circuit, including a first power supply, the cathode assembly, and the anodic material, which is completed when the anodic material engages the electrolyte in the tank; a second electrical circuit, including a second power supply, the cathode, and the anodic material, which is completed when the electrolyte impinges on the anodic material; a device for removing the electrolyte from the material; and a control unit for automatically controlling the apparatus.

The present invention also provides a method of electrochemically processing to achieve a final surface finish on a material including simultaneously electropolishing and electroetching the material, sequentially electroetching then electropolishing the material, or sequentially mechanically burnishing then electropolishing the material. Finally, the present invention provides an electrolytic solution having two parts by volume of concentrated phosphoric acid, one part by volume of concentrated sulfuric acid, one part by volume of glycerol, and varying amounts (from 0–40 grams per liter of solution) of sodium chloride.

It is to be understood that both the foregoing general description and the following restrictive, of the invention.

BRIEF DESCRIPTION OF THE DRAWINGS

The invention is best understood from the following detailed description when read in connection with the accompanying drawings, in which.

DETAILED DESCRIPTION OF THE INVENTION

Figure 1:
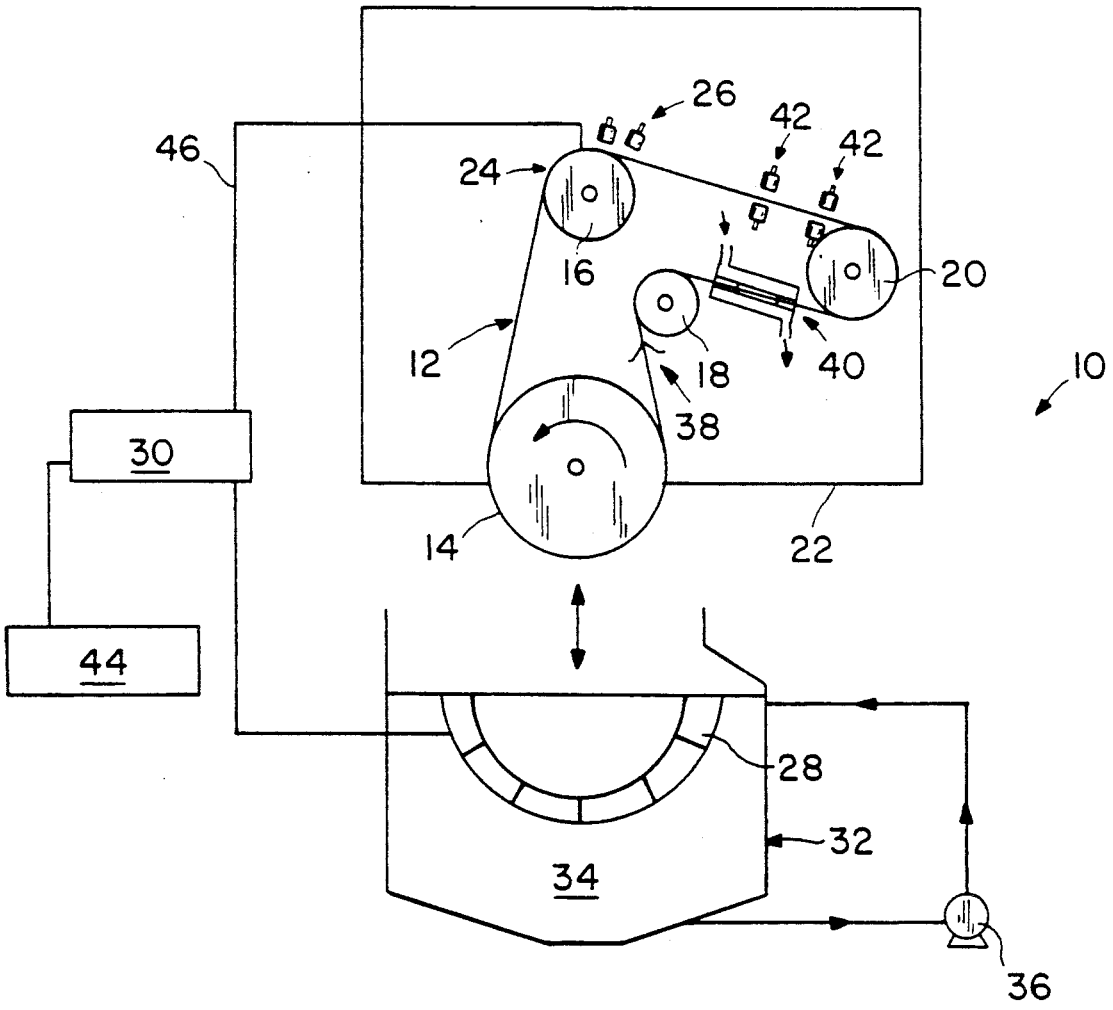
FIG. 1 is a schematic diagram of the apparatus constructed in accordance with the present invention, highlighting the components used to electropolish.

FIG. 1 illustrates the apparatus 10 of the present invention for electrolytically processing stainless steel print bands. Only the components of apparatus 10 used to electropolish are shown in FIG. 1.

The print band 12, which is anodic, is mounted on a series of pulleys. In FIG. 1, four pulleys 14, 16, 18, and 20 are shown. These pulleys are, in turn, mounted on an aluminum plate 22 which can be moved up and down. Drive pulley 14 is connected to a motor (not shown) and moves print band 12 at a predetermined speed either forward or backward. Second pulley 16, the top pulley shown in FIG. 1, includes a stainless steel wheel and a shaft where the electrical connection 24 to print band 12 is made. Second pulley 16 can be fixed at different positions on plate 22 so that various print bands 12 of different lengths can be processed.

To minimize the heating of print band 12 which occurs at electrical connection 24, a pair of compressed air jets 26 are provided over second pulley 16. Air jets 26 allow the use of relatively high currents (up to 60 amperes) through print band 12 without encountering problems with heating and sparking.

The cathode assembly consists of six graphite blocks 28, arranged in the form of a hemisphere. Graphite blocks 28 are connected to a stainless steel plate (not shown) which is connected to the negative pole of the power supply 30. A power supply 30 having 300 amperes and 100 volt capability is suitable. During electropolishing, drive pulley 14 faces the stationary cathode and moves over that cathode a certain preset distance.

The cathode assembly is mounted on a PVC tank 32 filled with the electrolyte 34. The level of electrolyte 34 is carefully maintained both to match the desired surface area of print band 12 which is to be dipped in electrolyte 34 and to assure a predetermined residence time during electropolishing. Thus, a uniform current density distribution is maintained over the entire surface of print band 12 exposed to electrolyte 34 without current losses. A small pump 36 can be used to circulate electrolyte 34.

A rinsing system is provided to remove electrolyte 34 from print band 12 after print band 12 leaves tank 32. The system includes a pair of Viton ® (a plastic) wipers 38 and a water rinser 40, which applies a stream of water. Several compressed air drying jets 42 are provided to dry print band 12 after rinsing.

Apparatus 10 can be enclosed inside a plexiglas cabinet (not shown) having a door in its front. Apparatus 10 is completely automated, being controlled by a control unit 44. A personal computer, as manufactured by the International Business Machines Corporation, is suitable as a control unit 44. For safety reasons, control unit 44 can be programmed to preclude starting the electropolishing operation unless the door of the cabinet is closed tightly. Software for control unit 44 can preset the length of print band 12 to be electropolished, the speed at which print band 12 moves, the direction of movement, the current, and the rinse time following electropolishing.

Apparatus 10 can electropolish several print bands 12 simultaneously, using the same power supply. Thus, a tremendous increase in output can be achieved. In operation, aluminum plate 22 of apparatus 10 carrying print band 12 first moves downward, traversing a distance which is preset to provide a desired inter-electrode spacing. Next, control unit 44 simultaneously and automatically triggers both movement of print band 12 and power supply 30. The electropolished print band 12 then moves out of tank 32, through wipers 38, around third pulley 18, through rinser 40, around fourth pulley 20, and through compressed air drying jets 42. Once print band 12 has moved a desired length, control unit 44 automatically switches power supply 30 off and aluminum plate 22 returns to its original position.

Apparatus 10 can electropolish both the front (having characters and timer marks) and back sides of print band 12. Such complete electropolishing first entails electropolishing the back side of print band 12. Print band 12 is then inverted and the electropolished (back) side is covered with a second, similarly sized print band devoid of characters. Then the front side of print band 12 is electropolished.

This procedure minimizes the effects of stray currents, which otherwise leave localized spots attacked on the back side of print band 12. Moreover, because electropolishing the back side of print band 12 yields a smooth surface, wear on print band 12 and on the printer's pulleys caused by friction during printing is reduced. That reduced wear eliminates the need for coatings or other lubricants now used between print band 12 and the pulleys of the printer.

The length of print band 12 is typically on the order of 48, 52, or 64 inches. For such a typical print band 12, the length of print band 12 which is dipped in electrolyte 34 is about 16 centimeters. Print band 12 moves at about 2.5 centimeters per second. A current of between 15 and 60 amperes, generating a current density of between 0.5 and 2 amperes per centimeter squared, is applied. With one pass defined as the length of print band 12, the usual number of passes applied to electropolish print band 12 using apparatus 10 is between one and three.

Apparatus 10 has been applied to electropolish print bands 12. It can complement traditional buffing to give print band 12 a final microfinish, or apparatus 10 can replace the presently used buffing technique. Typical microfinishing results obtained by apparatus 10 are shown in FIG. 2, which compares the scanning electron microphotographs of surfaces of an unbuffed, a buffed, and an electropolished print band 12 using apparatus 10.

Figures 2, 2A, 2B, 2C:
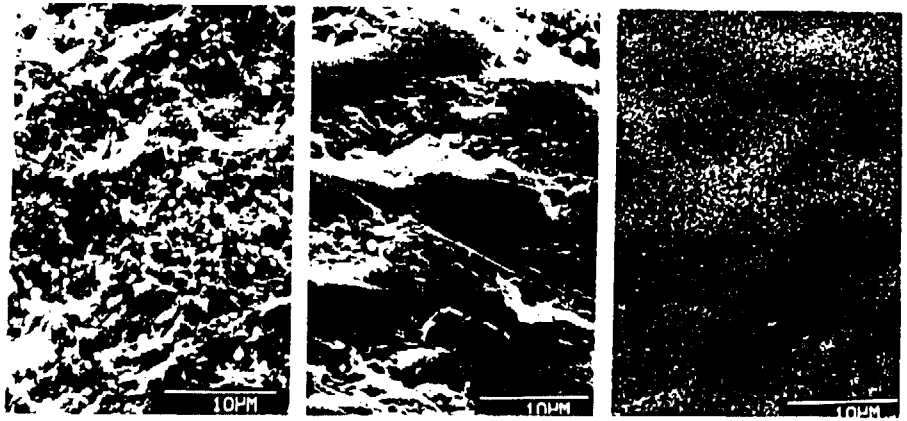
FIG. 2 shows three scanning electron microphotographs of differently treated print band surfaces.
FIG. 2*a* shows an untreated surface.
FIG. 2*b* shows a buffed surface.
FIG. 2*c* shows a surface electropolished using the apparatus of the present invention.

The unbuffed surface of FIG. 2*a* is highly textured and extremely rough. Numerous scratches are uniformly distributed over the buffed surface of FIG. 2*b*. The electropolished surface of FIG. 2*c*, however, is uniformly flat even on the microscopic scale, except for a few micropits. Moreover, the electropolished surface is free of the mechanically induced stresses typical of buffing.

Figure 3:
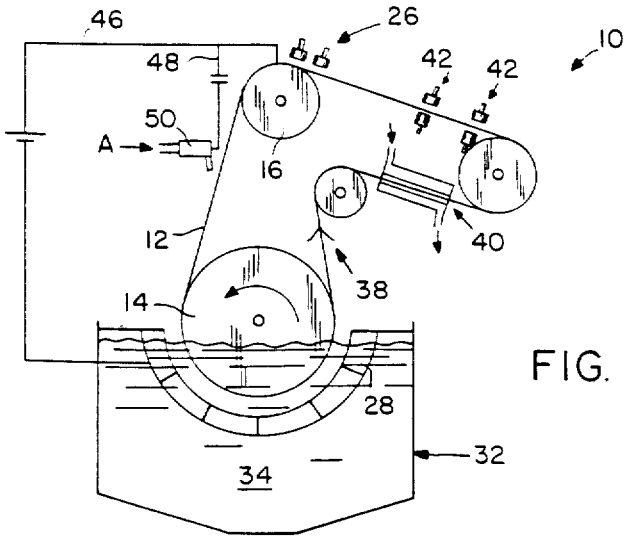
FIG. 3 is a schematic diagram of the apparatus constructed in accordance with the present invention, showing both the components used to electropolish and those used to electroetch.
Figure 4A:
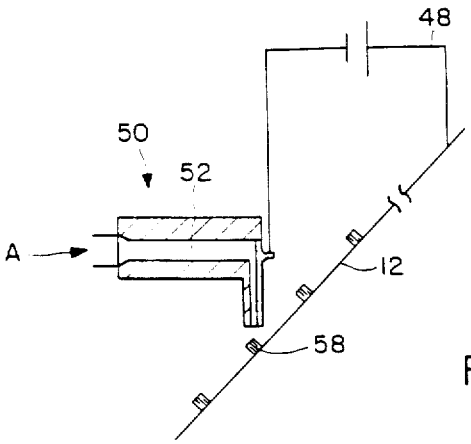
FIG. 4*a* is a schematic diagram of the apparatus constructed in accordance with the present invention, highlighting the positioning of the electrolytic jet used to obtain electroetching.
Figure 4B:
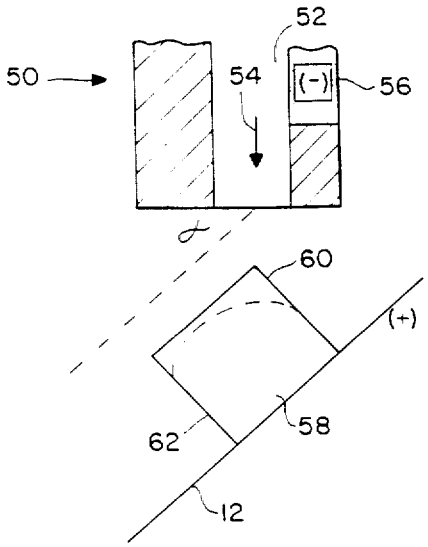
FIG. 4*b* is an expanded view of the positioning of the electrolytic jet shown in FIG. 4*a;*

Certain printer applications demand that the characters on print band 12 be rounded. Character rounding requires different degrees of carefully controlled, selective metal removal from the leading and trailing edges of the characters during processing. As shown in FIGS. 3, 4*a*, 4*b*, apparatus 10 can incorporate an electroetching unit able to achieve such rounding through directional, localized electroetching.

The electroetching unit includes a second electrical circuit 48, separate from the first electrical circuit 46 used to electropolish. Although first circuit 46 is connected to power supply 30, second circuit 48 has its own power supply (not shown). The unit also includes a housing 50 defining a rectangular slot 52. Electrolyte 34 enters housing 50 on one end (see arrow A in FIGS. 3 and 4*a*), travels through slot 52, and exits housing 50 has an electrolytic jet 54 directed at moving print band 12.

A 200-micron thick, Teflon® spacer is suitable for forming housing 50. A cut in the center of housing 50 creates slot 52. A stainless steel plate 56 on one side of slot 52 provides the cathode of the electroetching unit. The positioning of housing 50 relative to the character 58 of print band 12 and the size of slot 52 are critical in obtaining the desired degree of rounding of the leading edge 60 and trailing edge 62 of character 58. As shown in FIG. 4*b*, in order to assure directional etching, housing 50 is placed sufficiently close to character 58 and at an angle $\alpha$ of about 45 degrees to print band 12 such that leading edge 60 of character 58 is preferentially etched.

Typically, a constant current of about 10 amperes is applied in the electroetching unit. For an estimated area of 18 square millimeters upon which electrolytic jet 54 impinges character 58, such a current is approximately equivalent to a current density of 55 amperes per centimeter squared.

The electropolishing system of apparatus 10 shown in FIG. 1 and the electroetching unit of apparatus 10 shown in FIG. 3 may be operated either concurrently or in sequence. In concurrent etching and polishing, the same electrolyte 34 is used for both character rounding and microfinishing. The current efficiency for metal dissolution in the electrolyte 34 designed for microfinishing is low. That low efficiency requires several passes of character 58 under electrolytic jet 54 to obtain sufficient character rounding. By using several electrolytic jets 54, the character rounding performance would be enhanced and the required number of passes would be reduced.

The advantage of concurrent character rounding and polishing is that the two processes occur at the same time using the same electrolyte 34. When only a small amount of character rounding is desired, concurrent etching and polishing will increase processing efficiency.

In order to obtain a higher degree of character rounding, the electroetching process should involve a high rate of metal dissolution. Such a high rate can be achieved in concentrated salt solutions, similar to those employed in electrochemical machining (e.g., 5M NaCl). These solutions are unsuitable as an electropolishing electrolyte 34, however, because they do not produce mirror finishing under present experimental conditions. Accordingly, a two-step, sequential process, including electroetching using a solution capable of rapid metal dissolution followed by electropolishing using electrolyte 34, is applied when higher degrees of character rounding are desired.

Figure 5:
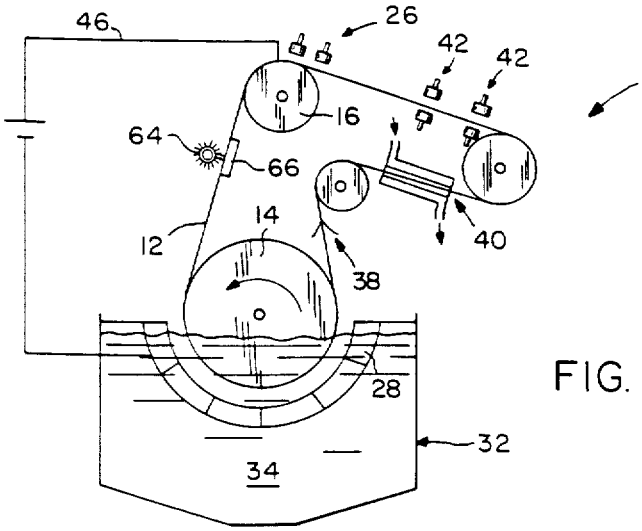
FIG. 5 is a schematic diagram of the apparatus constructed in accordance with the present invention, illustrating the substitution of mechanical burnishing for the electrolytic jet of FIGS. 3, 4*a*, and 4*b;*

As an alternative to electroetching using an electrolytic solution, character rounding can be achieved through mechanical burnishing. As FIG. 5 shows, a small, mechanical brush 64 can replace the electroetching unit in apparatus 10. Brush 64 rotates at a constant speed and is held over print band 12 as print band 12 moves. A stainless steel base 66 positioned behind print band 12 avoids deformation of print band 12 and ensures that sufficient pressure is applied during burnishing. Brush 64 may be made of steel or of nylon impregnated with an abrasive such as alumina, TiC, or the like.

Character rounding using brush 64 is rapid. Fine adjustment of brush 64 is required, however, to obtain reproducible results. Moreover, brush 64 will introduce scratches on the surface of print band 12, although these scratches can be removed by applying the electropolishing process for a few passes. As with the electroetching process, the mechanical burnishing process can be applied concurrently or in sequence with electropolishing.

Figure 6A:
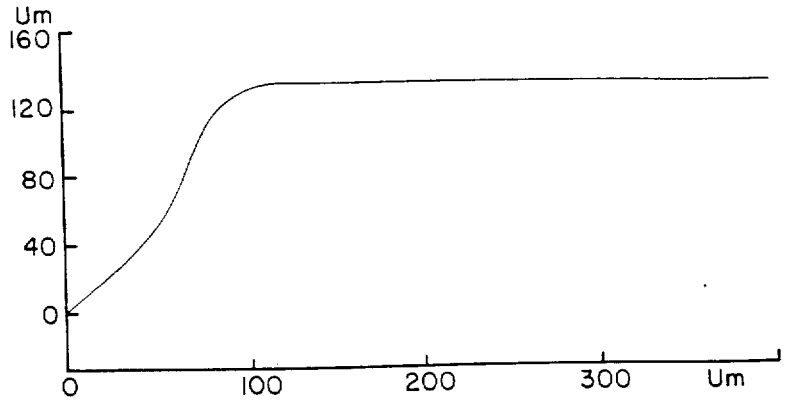
FIG. 6*a* is a profilometer trace showing the character rounding before the print band enters the apparatus constructed in accordance with the present invention.
Figure 6B:
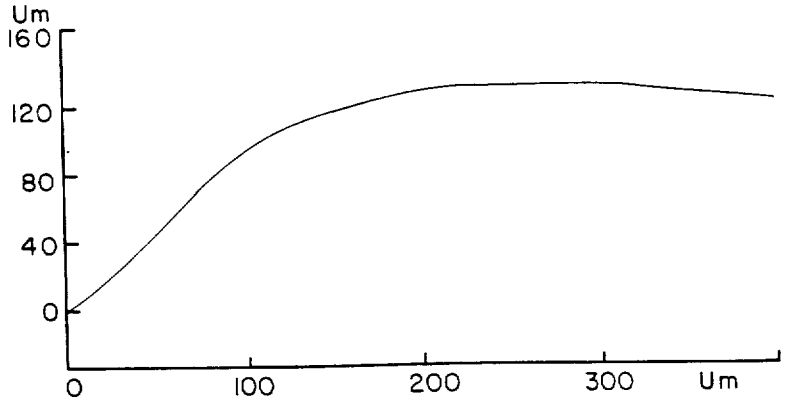
FIG. 6*b* is a profilometer trace showing the character rounding after the print band leaves the apparatus constructed in accordance with the present invention.

FIGS. 6*a* and 6*b* illustrate the degree of character rounding which may be obtained using apparatus 10. FIG. 6*a* shows a typical profile of the leading edge 60 of character 58 before print band 12 enters apparatus 10. Although apparatus 10 may be used to obtain various degrees of rounding, depending upon, among other things, which type of electrolyte is used in the electroetching process and whether burnishing or electroetching is applied, FIG. 6*b* shows a typical profile of the leading edge 60 of character 58 after print band 12 leaves apparatus 10. Character rounding varying between 0.01 and 0.25 millimeters has been obtained. That range is well within the specifications prescribed for the typical print band 12 used in high speed printers.

In sum, apparatus 10 is capable of applying a number of processes to print band 12. Specifically, such processes include: (1) electropolishing alone; (2) electroetching alone; (3) concurrent electroetching and electropolishing; and (4) sequential electroetching and electropolishing. Moreover, the electroetching process may be replaced by a mechanical burnishing operation.

Print band 12 is generally made of a hardened ferritic stainless steel, such as high strength 13% Cr ferritic stainless steel. The chemical composition of that alloy is as follows: Fe (83.35%–84.95%); Cr (13.10%–13.90%); Mo (0.90%–1.10%); Mn (0.40%–0.65%); Si (0.30%–0.55%); C (0.35%–0.41%); P (0.025% maximum); S (0.015% maximum). Because it contains a large number of impurity elements, the alloy is not amenable to electropolishing using known electrolytic solutions and conditions. Therefore, successful electropolishing of print band 12 to achieve microfinishing required development of a suitable electrolyte 34 and operating parameters.

Conventional wisdom indicates that electropolishing of stainless steels on an industrial scale is most easily done in concentrated phosphoric acid-sulfuric acid solutions. Accordingly, such solutions were selected as the starting point for development of a successful electrolyte 34.

Figure 7C:
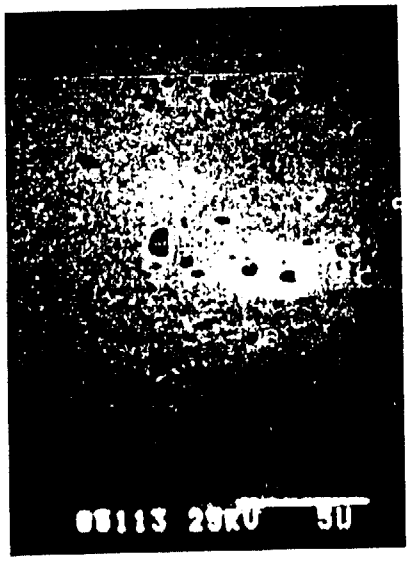
FIG. 7*c* shows the scanning electron microphotograph of a stainless steel print band after treatment in the electrolyte of the present invention.
Figure 7B:
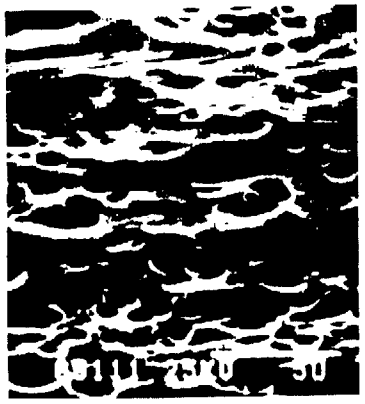
FIG. 7*b* shows the scanning electron microphotograph of a stainless steel print band after treatment in concentrated phosphoric acid (2 parts by volume) and sulfuric acid (1 part) at a current density of 5 amperes per centimeter squared.
Figure 7A:
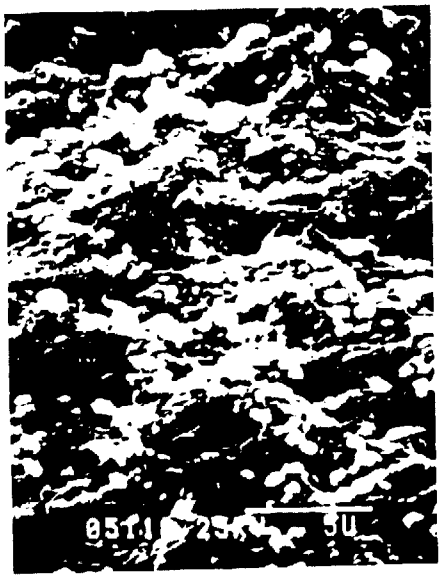
FIG. 7*a* shows the scanning electron microphotograph of a stainless steel print band before treatment by the process of the present invention.

FIG. 7*a* shows the scanning electron microphotograph of a stainless steel print band 12 before treatment. The average surface roughness is on the order of 0.3 microns. When electropolished at current densities ranging from 1 to 5 amperes per centimeter squared in mixtures of phosphoric and sulfuric acids, the surface roughness of print band 12 worsened. See, for example, the scanning electron microphotograph (FIG. 7*b*) of stainless steel print band 12 after treatment in concentrated phosphoric acid (2 parts by volume) and sulfuric acid (1 part) at 5 amperes per centimeter squared, which shows uniformly distributed pits over the entire surface. Thus, at least at current densities up to 5 amperes per centimeter squared, phosphoric-sulfuric acid solutions were ineffective at ambient temperature.

In such solutions, electropolishing of stainless steels occurs in the transpassive potential region in which the relative proportion of passivating and depassivating agents in the electrolyte govern the metal dissolution reaction. Additives to the solutions influence that reaction.

It was discovered that the addition of glycerol to a phosphoric-sulfuric acid mixture yielded highly reflecting and polished surfaces. Strongly oxidizing agents, such as nitric and chromic acid, caused highly localized attack and yielded extremely rough surfaces. The addition of various alcohols, such as butyl alcohol and isopropyl alcohol, to a mixture of phosphoric-sulfuric acid failed to improve the surface finish of the stainless steel print band 12. Glycerol changes the viscosity of electrolyte 34; it alters the transport properties of the dissolving metal ions, thus controlling the surface finishing process.

Figure 8:
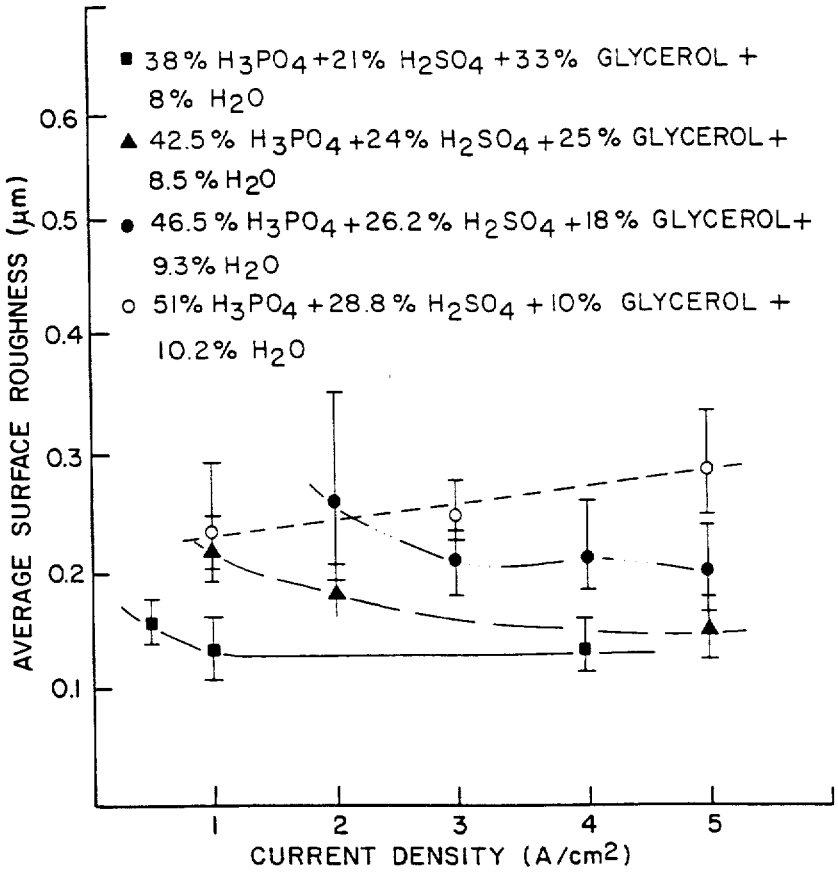
FIG. 8 shows the average surface roughness of a print band as a function of current density after treatment in electrolytes containing different amounts of glycerol.

FIG. 8 shows the average surface roughness of print band 12 as a function of current density in electrolytes containing different amounts of glycerol. The electrolyte compositions shown in FIG. 8 were formed by adding different amounts of glycerol to a mixture of two parts by volume of concentrated (85%) phosphoric acid and one part by volume of concentrated (96%) sulfuric acid. The water present in the compositions was contained in the acids; it was not added. Each point in FIG. 8 is an average of at least five measurements taken at different locations in print band 12 and the vertical lines indicate data scattering.

A mirrored microfinished surface corresponds to an average surface roughness of up to about 0.2 microns. As shown in FIG. 8, a certain minimum amount of glycerol is required to achieve adequate electropolishing. In an electrolyte 34 containing 10% glycerol, for example, successful electropolishing could not be obtained up to a current density of 5 amperes per centimeter squared. Highly reflecting surfaces were achieved at a current density as low as 0.5 amperes per centimeter squared, however, in an electrolyte containing 33% glycerol. Moreover, electrolytes containing 25% and 33% glycerol yielded satisfactory surfaces over a wide range of current densities. The scanning electron microphotograph (FIG. 7*c*) of a surface treated with a 25% glycerol electrolyte shows that, except for small pits at random locations, the surface is nearly flat.

Thus, FIG. 8 indicates that an electrolyte having a composition within the following approximate ranges will achieve satisfactory surface results: 35–45% phosphoric acid, 20–25% sulfuric acid, 20–35% glycerol, and 8–9.5% water.

Figure 9:
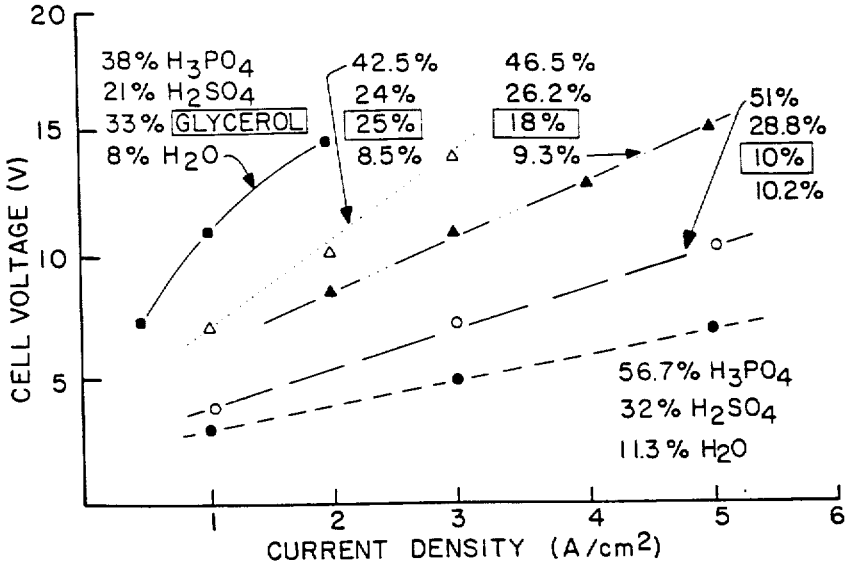
FIG. 9 shows the cell voltage as a function of current density in a phosphoric-sulfuric acid with different amounts of glycerol.

FIG. 9 shows the cell voltage as a function of current density in phosphoric-sulfuric acid with different amounts of glycerol. Although the voltage values shown are relative, for they depend upon the specific cell geometry, they illustrate that large amounts of glycerol increase the cell voltage and, hence, the power requirement and heating problem. That increase occurs because an increase in glycerol content decreases the conductivity of electrolyte 34.

Accordingly, the addition of glycerol to phosphoric-sulfuric acid mixtures generates a tradeoff: higher glycerol amounts, at least up to 33%, reduce surface roughness but increase power requirements. An electrolyte 34 containing two parts by volume phosphoric acid, one part by volume sulfuric acid, and one part by volume glycerol (the 2:1:1 electrolyte) has proven suitable to successfully microfinish hardened 13% Cr stainless steels at ambient temperature over a wide range of current densities without taxing the power supply or exacerbating heating problems.

The 2:1:1 electrolyte is stable; it does not degrade or polymerize appreciably over time. In general, the effects on microfinish of electrolyte aging and of the dissolved metal products which accumulate in the electrolyte are of concern. Experiments have shown, however, that these effects are negligible using the 2:1:1 electrolyte. The 2:1:1 electrolyte is also relatively nontoxic (permitting exposure without harm), noncorrosive (allowing the electrolyte to function in pumps and pipes over time), and effective under stationary conditions (requiring no agitation) at ambient temperature.

Moreover, the process of electropolishing stainless steels occurs at or beyond a limiting current density whose value is controlled by mass transport and which corresponds to the attainment of a saturation concentration at the surface causing precipitation of a salt film. As metallic ions are incorporated in the electrolyte, the value of the limiting current decreases. Therefore, these metallic ions ensure that the operating current density remains well above the limiting current density.

An important aspect of electropolishing is the amount of material removed. To achieve a reproducible manufacturing process, it is essential to know the thickness of the material that will be removed during electropolishing. That thickness can be determined from weight loss measurements where weight loss, W, is related to the metal dissolution stoichiometry by the Faraday Law: $W=(QM_{alloy}/(nF)$, where W is weight loss ($g/cm^2$), Q is charge ($=It/A$)($C/cm^2$), I is current (amperes), t is time (seconds), A is surface area ($cm^2$), $M_{alloy}$ is the molecular weight of the alloy (g/mole), n is the dissolution valence, and F is Faraday's constant.

The dissolution valence, n, corresponds to the number of electrons released during the anodic dissolution process and is a measure of the rate of material removal for a given current density. As the dissolution valence increases, the weight loss (amount of metal dissolution) decreases, and vice-versa.

Figure 10:
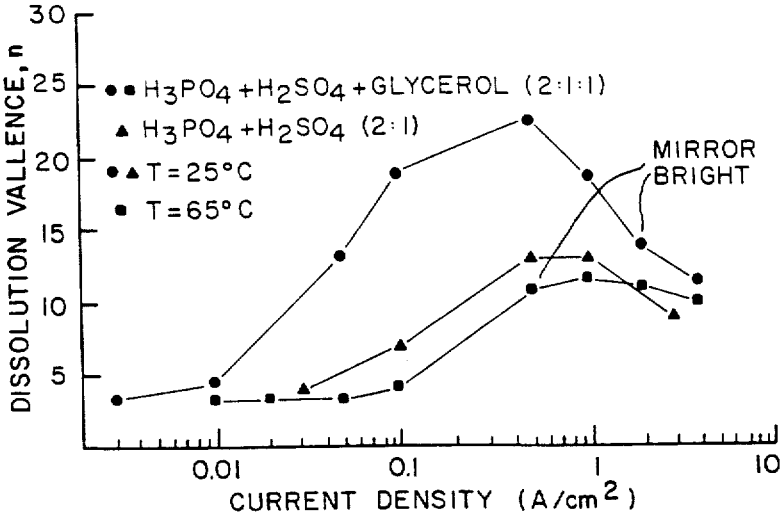
FIG. 10 shows the variation in the dissolution valence as a function of current density and temperature in a phosphoric-sulfuric acid and in the electrolyte of the present invention.

FIG. 10 shows the variation in the dissolution valence as a function of current density and temperature in the phosphoric-sulfuric acid and 2:1:1 electrolytes. At low current densities, the dissolution valence is about 3.4, corresponding to the formation of $Fe^{3+}$ and $Cr^{6+}$ and indicating that the metal dissolution reactions involve formation of the highest valence species. The arrows in FIG. 10 indicate the current density at and beyond which mirror surface finishes are obtained.

The high dissolution valence values at high current densities indicate that oxygen evolution is occurring simultaneously with metal dissolution. In the 2:1:1 electrolyte, the dissolution valence is about 15 at a current density of 2 amperes per centimeter squared and a temperature of 25 degrees centigrade. This suggests that the amount of current used (the current efficiency) for metal dissolution under these conditions is about 23%, with the remainder consumed for oxygen evolution.

Note that an increase in temperature lowers the current density for the onset of mirror finishing. Moreover, in the high current density region where microfinishing is obtained, the dissolution stoichiometry is nearly independent of current density. Thus, an increase in local temperature (which may occur at high current density during electropolishing) does not adversely effect the microfinish and the electropolishing process is virtually insensitive to temperature rise under these conditions. The process can be carried out at ambient temperature over a wide range of current density.

Although a dissolution current efficiency of only 23% may be sufficient for most finishing operations in which surface roughness alone is removed, a wide range in the material removal rate is desired to gain wider applicability for the electropolishing process. In order to achieve a wider range in a controlled manner, the ratio of the passivating to the non-passivating anions in the electrolyte can be changed. This change is achieved by adding different amounts of water (a passivating agent) and chloride ions (a non-passivating agent).

Figure 11:
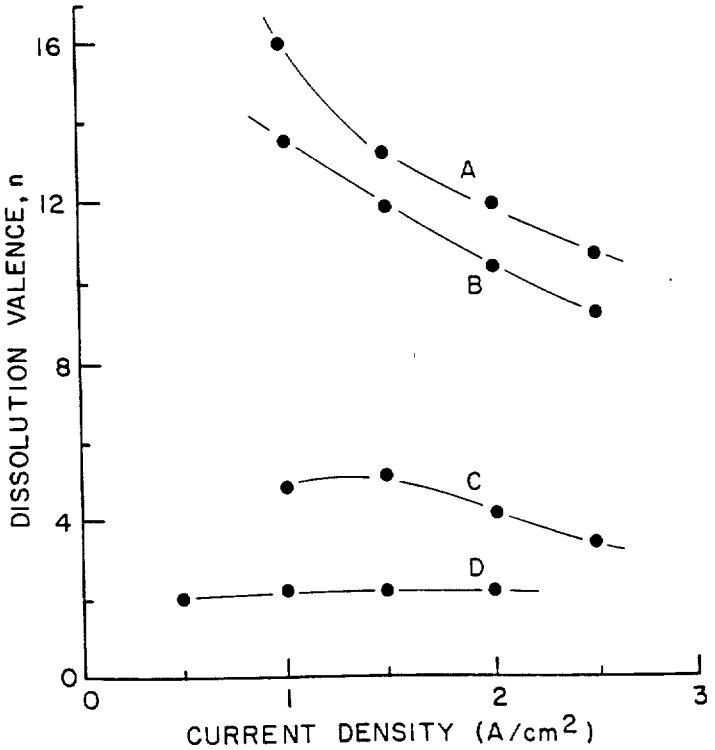
FIG. 11 shows the dissolution valence of a number of electrolyte solutions containing varying amounts of sodium chloride ((A) two parts by volume phosphoric acid+one part by volume sulfuric acid+one part by volume glycerol, (B) 100 cc of phosphoric acid+50 cc of sulfuric acid+100 cc of glycerol+50 cc of water+10 g of salt, (C) 100 cc of phosphoric acid+25 cc of sulfuric acid+100 cc of glycerol+100 cc of water+15 g of salt, (D) 100 cc of phosphoric acid+100 cc of glycerol+100 cc of water+18 g of salt) as a function of current density, illustrating the effect of chloride ions in the electrolyte on the metal removal rate.

Experiments were conducted on four, separate electrolytic solutions: (A) the 2:1:1 electrolyte, (B) 100 cc of phosphoric acid+50 cc of sulfuric acid+100 cc of glycerol+50 cc of water+10 g of salt, (C) 100 cc of phosphoric acid+25 cc of sulfuric acid+100 cc of glycerol+100 cc of water+15 g of salt, (D) 100 cc of phosphoric acid+100 cc of glycerol+100 cc of water+18 g of salt. FIG. 11 shows the dissolution valence of each solution as a function of current density. The surfaces treated with solution (D) were unacceptable, having pits and other forms of localized attack. The other three electrolytes provided satisfactory microfinish, however, despite a high current efficiency for metal removal.

Thus, addition of a small amount of sodium chloride in the electrolyte can augment the metal dissolution reaction, by suppressing the oxygen evolution reaction, without adversely affecting the microfinish during electropolishing. The presence of chloride ions in the electrolyte may shift the anodic dissolution to its active mode, forming metallic species in their lowest valence state. The results achieved are particularly suitable for electroetching to round the characters of the print band, because such rounding requires greater material removal.

Although the invention is illustrated and described herein as embodied (a) in an apparatus for electropolishing an anodic material in strip form including a movable plate; elements attached to the plate for moving the material at a predetermined speed; a tank positioned at a predetermined distance from the elements and containing a cathode assembly and an electrolyte; a housing having a cathode and defining a slot through which electrolyte flows before impinging on the material; a first electrical circuit, including a first power supply, the cathode assembly, and the anodic material, which is completed when the anodic material engages the electrolyte in the tank; a second electrical circuit, including a second power supply, the cathode, and the anodic material, which is completed when the electrolyte impinges on the anodic material; a device for removing the electrolyte from the material; and a control unit for automatically controlling the apparatus, (b) in a method of electrochemically processing to achieve a final surface finish on a material including simultaneously electropolishing and electroetching the material, sequentially electroetching then electropolishing the material, or sequentially mechanically burnishing then electropolishing the material, and (c) in an electrolytic solution having two parts by volume of concentrated phosphoric acid, one part by volume of concentrated sulfuric acid, one part by volume of glycerol, and varying amounts of sodium chloride, the invention is nevertheless not intended to be limited to the details shown. Rather, various modifications may be made in the details within the scope and range of equivalents of the claims and without departing from the spirit of the invention.

For example, although apparatus 10 of the present invention has been described above as applied to electropolish and to electroetch a print band, it is clear that apparatus 10 is equally applicable to electropolish, electroetch, or both electropolish and electroetch many other materials in strip form. Moreover, the electropolish and electroetch processes described above may be applied independently of apparatus 10.

What is claimed is:

1. An apparatus for electropolishing an anodic material provided in strip form comprising:

a movable plate;

means attached to said plate for moving said material at a predetermined speed;

a tank positioned at a predetermined distance from said moving means on said movable plate and adapted for containing an electrolyte;

a cathode assembly mounted to said tank and adapted to be surrounded by said electrolyte;

a first power supply having a negative pole connected to said cathode assembly and a positive pole connected to said anodic material at a point of electrical connection;

a first electric circuit including:

(a) said first power supply, (b) said cathode assembly, and (c) said anodic material, said circuit being completed when said movable plate travels said predetermined distance so that said anodic material engages said electrolyte in said tank;

means for removing said electrolyte from said material after said material engages said electrolyte in said tank; and a control unit for automatically controlling said apparatus.

2. An apparatus as claimed in claim 1 wherein said moving means can be selectively attached at different locations on said plate.

3. An apparatus as claimed in claim 1 further comprising a compressed air jet positioned adjacent said electrical connection for minimizing the heating and sparking of said material at said electrical connection.

4. An apparatus as claimed in claim 1 wherein said power supply can provide a current of 300 amperes and a voltage of 100 volts.

5. An apparatus as claimed in claim 1 wherein said cathode assembly comprises a stainless steel plate and plurality of graphite blocks arranged to form a hemisphere, said blocks being connected to said stainless steel plate.

6. An apparatus as claimed in claim 1 wherein said removal means includes:

a wiper;

a water rinser for applying a stream of water to said material; and a drying jet for delivering compressed air to said material, thereby drying said material.

7. An apparatus as claimed in claim 1 further comprising a pump for circulating said electrolyte.

8. An apparatus as claimed in claim 1 wherein said anodic material is a stainless steel printer band.

9. A method of electrochemically processing an anodic material provided in strip form comprising:

affixing a strip of said material to a means for moving said material at a predetermined speed, said moving means attached to a movable plate;

moving said plate toward a tank positioned at a predetermined distance from said moving means on said movable plate and containing an electrolyte, traversing said predetermined distance between said plate and said tank, so that said material engages said electrolyte in said tank;

triggering movement of said strip of said material on said moving means;

simultaneously triggering operation of a first power supply having a negative pole connected to a cathode assembly mounted to said tank and surrounded by said electrolyte and a positive pole connected to said anodic material at a point of electrical connection;

removing said electrolyte from said material after said material engages said electrolyte in said tank;

turning said power supply off;

returning said plate to its original position a predetermined distance away from said tank; and removing said strip of said material from said moving means.

10. A method of electrochemically processing as claimed in claim 9 wherein the steps are automatically controlled by a control unit.

11. A method of electrochemically processing as claimed in claim 9 further comprising, after removing said strip of said material from said moving means:

inverting said strip of said material;

covering the side of said strip of said material which has already been processed with a second, similarly sized strip of said material;

reprocessing said strip of said material.

12. A method of electrochemically processing as claimed in claim 11 wherein said anodic material is a stainless steel printer band having a front side with characters and a back side, said back side being processed first.

13. An apparatus for electrochemically processing an anodic material provided in strip form comprising:

means for moving said strip of said anodic material at a predetermined speed;

a housing including an exit directed toward said strip of said anodic material and an inlet, said housing defining a slot between said inlet and said exit;

a cathode positioned in a wall of said housing defining said slot;

means for providing an electrolyte to said slot at said inlet of said housing, said electrolyte passing through said slot past said cathode and exiting said slot at said exit of said housing directed toward said strip of said anodic material;

a power supply having a negative pole connected to said cathode and a positive pole connected to said anodic material at a point of electrical connection;

an electric circuit including:

(a) said power supply, (b) said cathode, and (c) said anodic material, said circuit being completed when said electrolyte contacts said cathode and engages said anodic material;

means for removing said electrolyte from said material after said electrolyte engages said material; and a control unit for automatically controlling said apparatus.

14. An apparatus as claimed in claim 13 wherein said power supply provides a current of about 10 amperes.

15. An apparatus as claimed in claim 13 wherein said exit of said housing forms an angle of 45 degrees with said strip of said anodic material.

16. An apparatus as claimed in claim 13 wherein said anodic material is a stainless steel printer band.

17. A method of electrochemical polishing an anodic material provided in strip form comprising:

affixing a strip of said material to a means for moving said material at a predetermined speed;

introducing an electrolyte to an inlet of a housing so that said electrolyte flows through a slot defined by said housing, exits an exit of said slot, and impinges on said anodic material;

triggering movement of said strip of said material on said moving means;

simultaneously triggering operation of a power supply having a negative pole connected to a cathode positioned in a wall of said housing defining said slot and a positive pole connected to said anodic material at a point of electrical connection;

removing said electrolyte from said material after said electrolyte impinges on said material;

turning said power supply off; and removing said strip of said material from said moving means.

18. A method of electrochemical polishing as claimed in claim 17 wherein the steps are automatically controlled by a control unit.

19. A method of electrochemical polishing to achieve a final surface finish on a material comprising simultaneously electropolishing and electroetching said material using an electrolyte which is two parts by volume of concentrated phosphoric acid, one part by volume of concentrated sulfuric acid, and one part by volume of glycerol.

20. A method as claimed in claim 19 wherein said electrolyte further includes chloride ions and water.

21. A method of electrochemical polishing to achieve a final surface finish on a material comprising:

(a) electroetching said material using an electrolyte selected from the group consisting of concentrated salt solutions and concentrated acid solutions containing chloride ions; then (b) electropolishing said material.

22. A method of electrochemical polishing to achieve a final surface finish on a material comprising:

(a) electroetching said material; then (b) electropolishing said material using an electrolyte which is two parts by volume of concentrated phosphoric acid, one part by volume of concentrated sulfuric acid, and one part by volume of glycerol.

23. A method as claimed in claim 22 wherein said electrolyte further includes chloride ions and water.

24. A method of electrochemical polishing to achieve a final surface finish on a material comprising:

(a) mechanical burnishing said material; then (b) electropolishing said material using an electrolyte which is two parts by volume of concentrated phosphoric acid, one part by volume of concentrated sulfuric acid, and one part by volume of glycerol.

25. A method as claimed in claim 24 wherein said electrolyte further includes chloride ions and water.

26. A solution for electrochemical polishing anodic materials comprising:

about 35–45% by volume of phosphoric acid;
about 20–25% by volume of sulfuric acid;
about 20–35% by volume of glycerol; and
about 8–9.5% by volume of water.

27. A solution for electrochemical polishing anodic materials as claimed in claim 26 wherein the solution comprises:

two parts by volume of concentrated phosphoric acid;
one part by volume of concentrated sulfuric acid; and
one part by volume of glycerol.

28. A solution for electrochemical polishing anodic materials comprising:

chloride ions;
about 35–45% by volume of phosphoric acid;
about 20–25% by volume of sulfuric acid;
about 20–35% by volume of glycerol; and
about 8–9.5% by volume of water.

29. A solution for electrochemical polishing anodic materials as claimed in claim 28 wherein the solution comprises:

about 100 cc of phosphoric acid;
between about 25 and 50 cc of sulfuric acid;
about 100 cc of glycerol;
between about 50 and 100 cc of water; and
between about 10 and 15 g of salt.

* * * * *

UNITED STATES PATENT AND TRADEMARK OFFICE

CERTIFICATE OF CORRECTION

PATENT NO. : 5,066,370

DATED : November 19, 1991

INVENTOR(S) : Andreshak, et. al.

It is certified that error appears in the above-identified patent and that said Letters Patent is hereby corrected as shown below:

Figs. 2-11 of the drawings should be added as shown on the attached pages.

Signed and Sealed this

Twenty-third Day of March, 1993

*Attest:*

STEPHEN G. KUNIN

*Attesting Officer*

*Acting Commissioner of Patents and Trademarks*